US008302696B2

(12) United States Patent
Williams et al.

(10) Patent No.: US 8,302,696 B2
(45) Date of Patent: Nov. 6, 2012

(54) ACTUATOR AND TUBULAR ACTUATOR

(75) Inventors: Jeffrey Charles Williams, Cypress, TX (US); Keven Michael O'Connor, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 297 days.

(21) Appl. No.: 12/754,804

(22) Filed: Apr. 6, 2010

(65) Prior Publication Data

US 2011/0240286 A1 Oct. 6, 2011

(51) Int. Cl.
*E21B 23/00* (2006.01)

(52) U.S. Cl. ..... 166/381; 166/207

(58) Field of Classification Search ..... 166/380, 166/387, 292, 293, 207, 208, 382, 381
See application file for complete search history.

(56) References Cited

U.S. PATENT DOCUMENTS

| | | | | |
|---|---|---|---|---|
| 4,936,386 | A * | 6/1990 | Colangelo | 166/292 |
| 5,901,789 | A * | 5/1999 | Donnelly et al. | 166/381 |
| 6,540,777 | B2 | 4/2003 | Stenzel | |
| 6,695,067 | B2 * | 2/2004 | Johnson et al. | 166/387 |
| 6,705,615 | B2 | 3/2004 | Milberger et al. | |
| 6,712,154 | B2 | 3/2004 | Cook et al. | |
| 6,854,522 | B2 | 2/2005 | Brezinski et al. | |
| 6,935,432 | B2 | 8/2005 | Nguyen | |
| 7,040,404 | B2 | 5/2006 | Brothers et al. | |
| 7,048,052 | B2 | 5/2006 | Hackworth et al. | |
| 7,121,352 | B2 | 10/2006 | Cook et al. | |
| 7,191,842 | B2 | 3/2007 | Hackworth et al. | |
| 7,216,706 | B2 | 5/2007 | Echols et al. | |
| 7,234,533 | B2 | 6/2007 | Gambier | |
| 7,252,142 | B2 | 8/2007 | Brezinski et al. | |
| 7,264,047 | B2 | 9/2007 | Brezinski et al. | |
| 7,363,975 | B2 | 4/2008 | Loughlin | |
| 7,617,874 | B2 | 11/2009 | Ocalan | |
| 2004/0055758 | A1 | 3/2004 | Brezinski et al. | |
| 2005/0023003 | A1 | 2/2005 | Echols et al. | |
| 2005/0092485 | A1 | 5/2005 | Brezinski et al. | |
| 2006/0037745 | A1 | 2/2006 | Hart et al. | |
| 2007/0029080 | A1 * | 2/2007 | Moyes | 166/179 |
| 2007/0267824 | A1 | 11/2007 | Baugh et al. | |
| 2008/0000646 | A1 * | 1/2008 | Thomson | 166/387 |
| 2009/0205840 | A1 * | 8/2009 | O'Connor et al. | 166/382 |
| 2009/0229835 | A1 * | 9/2009 | Filippov | 166/380 |
| 2010/0078179 | A1 * | 4/2010 | Mack | 166/380 |
| 2010/0314111 | A1 * | 12/2010 | Karcher et al. | 166/293 |

OTHER PUBLICATIONS

Hackworth, M., et al. "Development and First Application of Bistable Expandable Sand Screen." SPE 84265. SPE Annual Technical Conference and Exhibition held in Denver, Colorado, U.S.A, Oct. 5-8, 2003. Retrieved online on Jan. 30, 2008 from "http://www.reslink.no/download/00084265.pdf" p 1-14.

Notification of Transmittal of the International Search Report and the Written Opinion of the International Searching Authority; PCT/US2010/062005; Mailed Jul. 28, 2011, Korean Intellectual Property Office.

* cited by examiner

*Primary Examiner* — Daniel P Stephenson
(74) *Attorney, Agent, or Firm* — Cantor Colburn LLP

(57) ABSTRACT

An actuator includes a tubular configured to longitudinally expand in response to radial expansion of at least a portion of the tubular.

18 Claims, 5 Drawing Sheets

ACTUATOR AND TUBULAR ACTUATOR

BACKGROUND OF THE INVENTION

Actuators in tubular systems, such as the downhole completion industry, employ a variety of motive devices. Electrical motors, solenoids, shape memory alloys and hydraulic systems, are a few of the motive devices successfully employed. Each motive device has specific advantages as well as drawbacks and each finds applications to which they are well suited. A wide variety of applications necessitate a wide variety of motive devices thereby assuring that operators of tubular systems remain receptive to new actuators employing new motive devices.

BRIEF DESCRIPTION OF THE INVENTION

Disclosed herein is an actuator that includes a tubular configured to longitudinally expand in response to radial expansion of at least a portion of the tubular.

Further disclosed herein is a tubular actuator that includes a sleeve and a tubular in operable communication with the sleeve configured to longitudinally expand in response to radial expansion thereof. A first portion of the tubular is longitudinally fixed to the sleeve so that a second portion of the tubular moves in relation to the sleeve in response to the longitudinal expansion of the tubular.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

Figure 1:
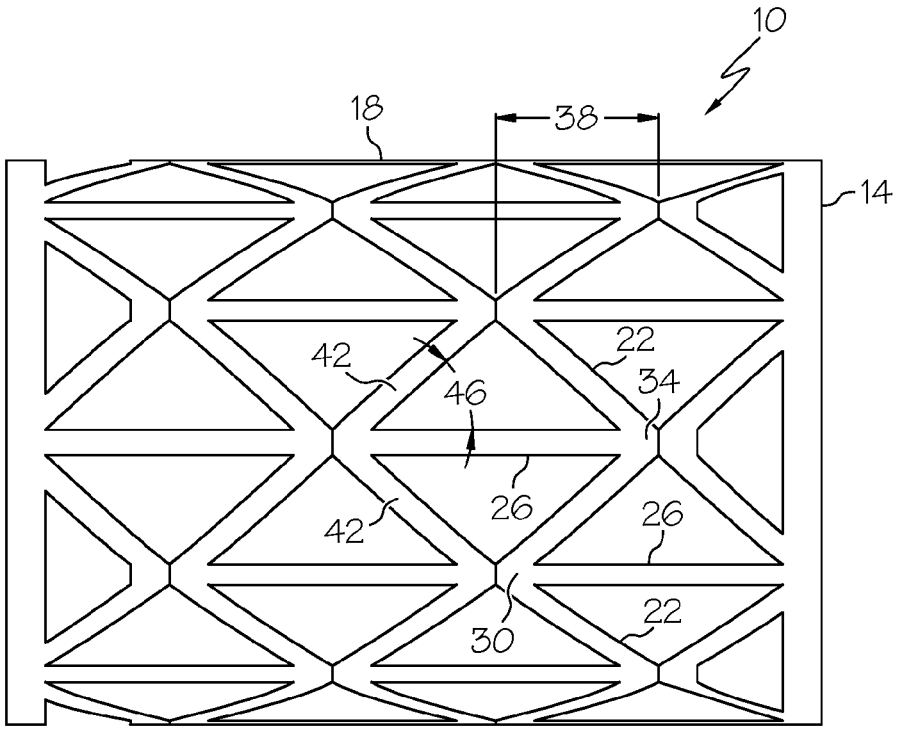
FIG. 1 depicts a side view of an actuator disclosed herein in a nonactuated configuration.
Figure 2:
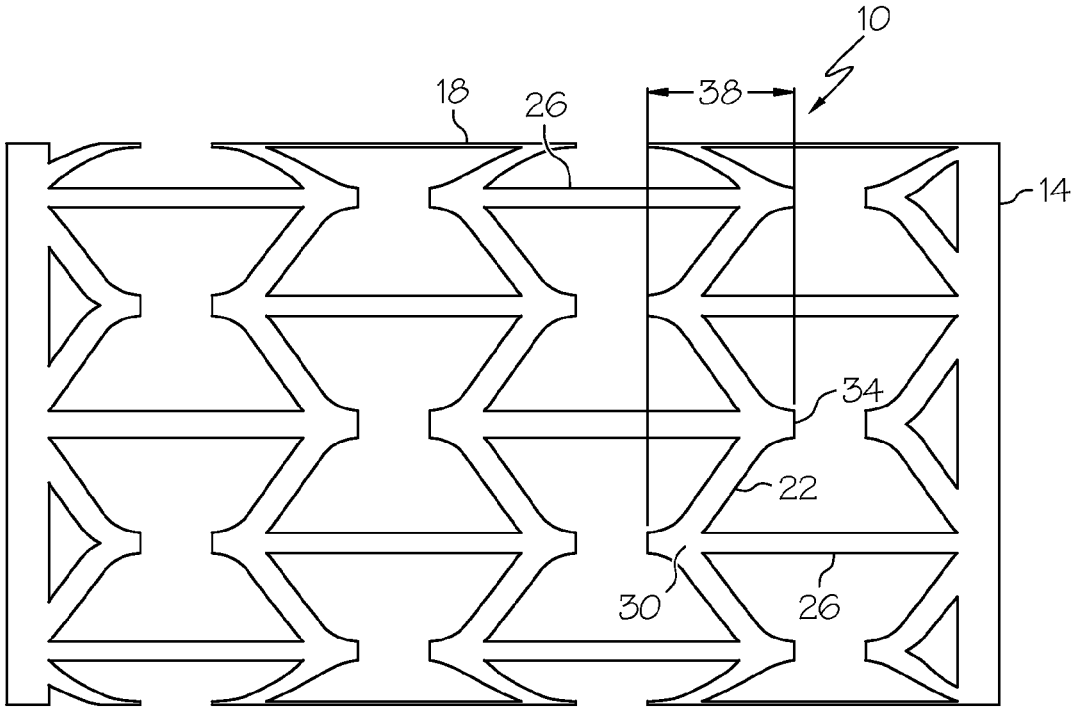
FIG. 2 depicts a side view of the actuator of FIG. 1 shown in an actuated configuration.
Figure 3:
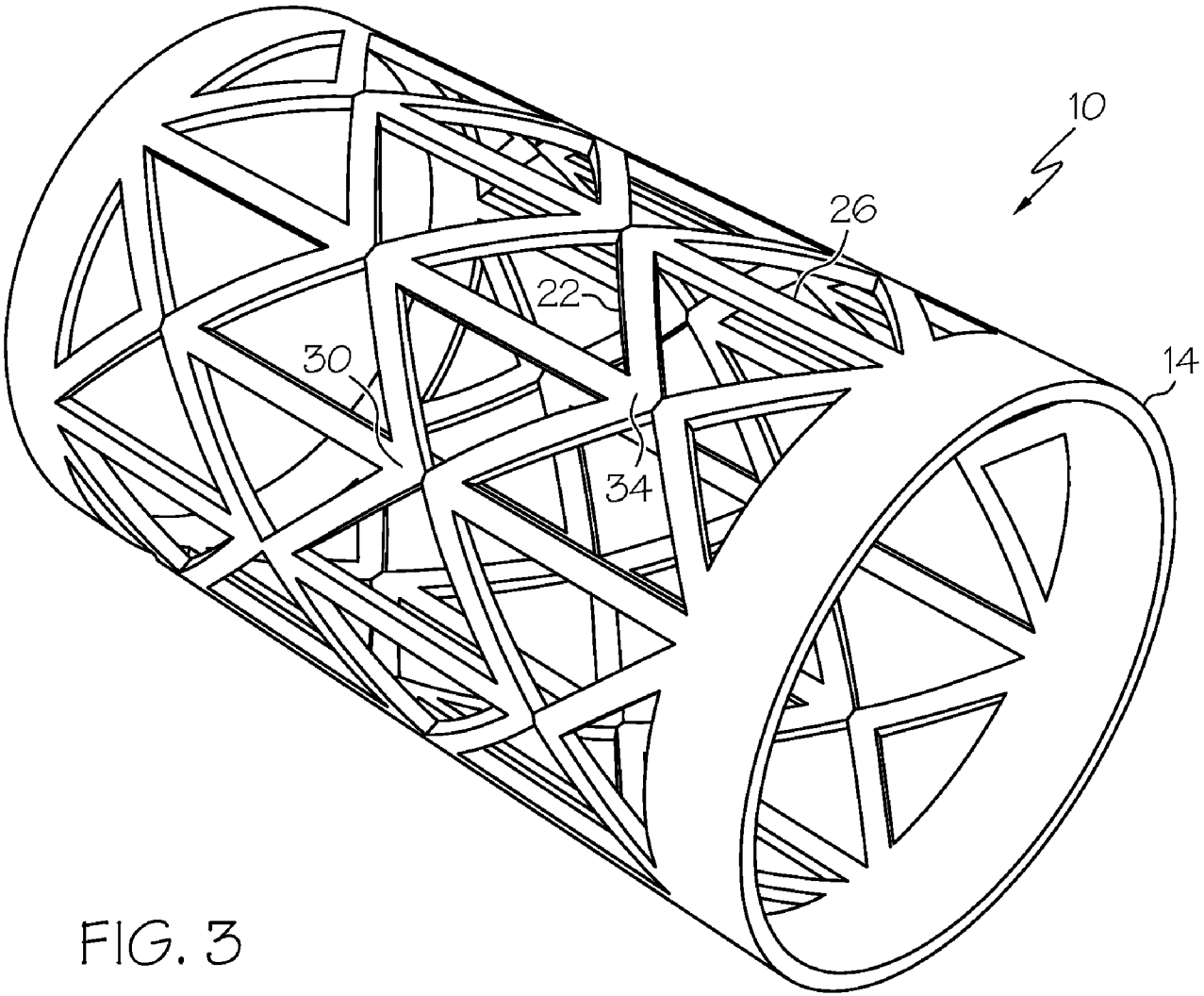
FIG. 3 depicts a perspective view of the actuator of FIG. 1.
Figure 4:
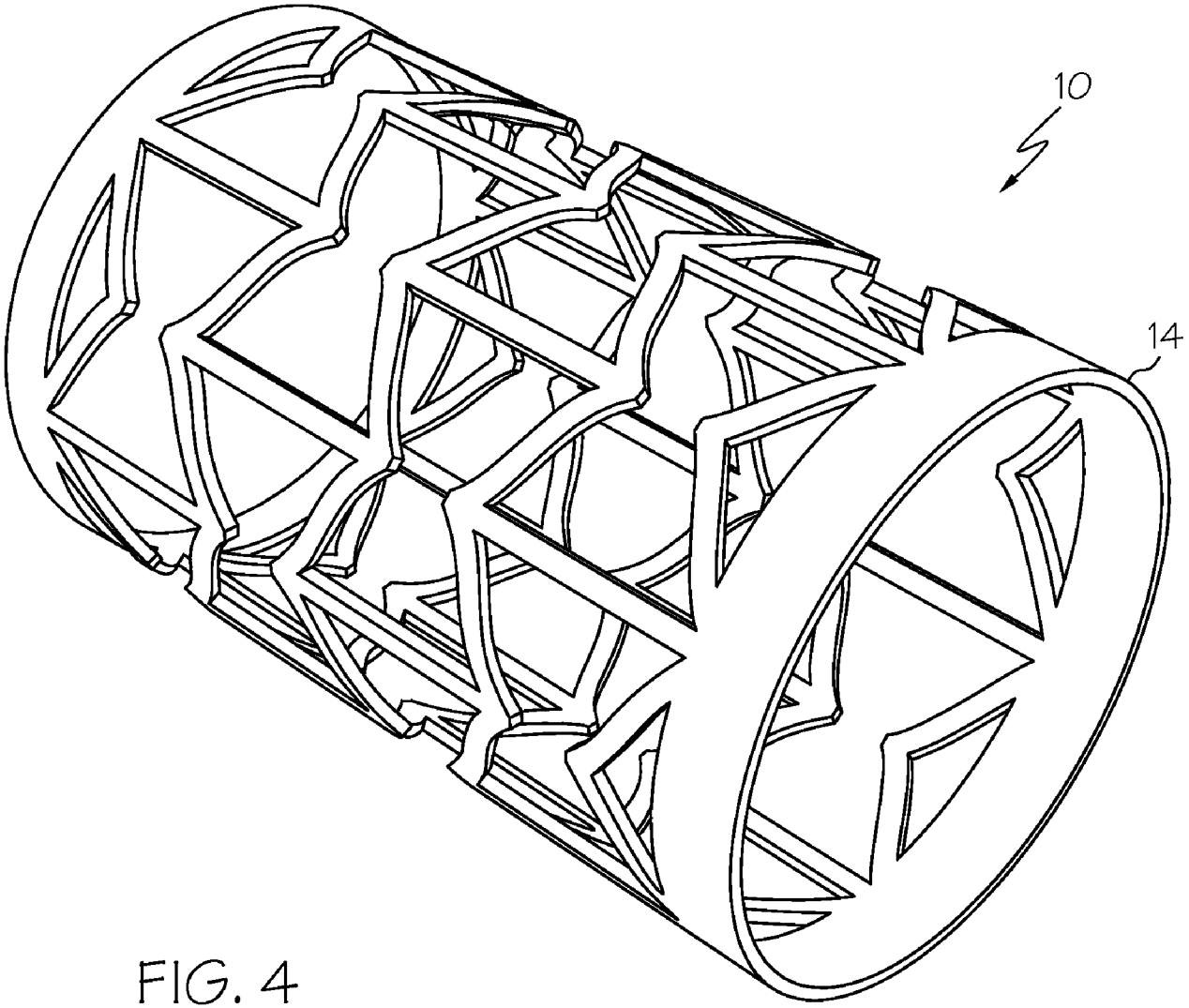
FIG. 4 depicts a perspective view of the actuator of FIG. 2.

A detailed description of one or more embodiments of the disclosed apparatus and method are presented herein by way of exemplification and not limitation with reference to the Figures.

Referring to FIGS. 1-4, an embodiment of an actuator disclosed herein is illustrated at 10. The actuator 10 includes, a tubular 14 with a discontinuous wall 18 having a plurality of serpentine or sinuous members 22 orientated substantially perimetrically about the tubular 14. The serpentine members 22 have longitudinal amplitudes with a plurality of bars 26 connected thereto. Pairs of the bars 26 that are perimetrically adjacent to one another have opposingly directed ends 30, 34 connected to a same one of the serpentine members 22. For example, the leftward end 30, as illustrated herein, of one of the bars 26 is connected to a same one of the serpentine members 22 as the rightward end 34 of the perimetrically adjacent bar 26 such that the ends 30, 34 longitudinally overlap one another. The amount of overlap in this embodiment is by a dimension 38. The decrease in dimension 38 in response to radial expansion of the actuator 10 is due to a decrease in amplitude of the serpentine member 22. This decrease of overlap puts the bars 26 in compression that causes a longitudinal growth of the actuator 10. This characteristic, longitudinal growth in response to radial growth is known as auxetic and is associated with the actuator 10 having a negative Poisson's ratio.

Straight portions 42 of the serpentine members 22 in this embodiment intersect the bars 26 at angles 46. The angles 46 increase as the amplitude of the serpentine members 22 decreases thereby approaching 90 degrees. As the angles 46 increase, during actuation, the bars 26 transmit compressive loads. These compressive loads cause adjacent serpentine members 22 to move longitudinally away from one another. Making the tubular 14 of a strong material, such as metal, for example, facilitates efficient transmission of the compressive forces through the bars 26.

Figure 5:
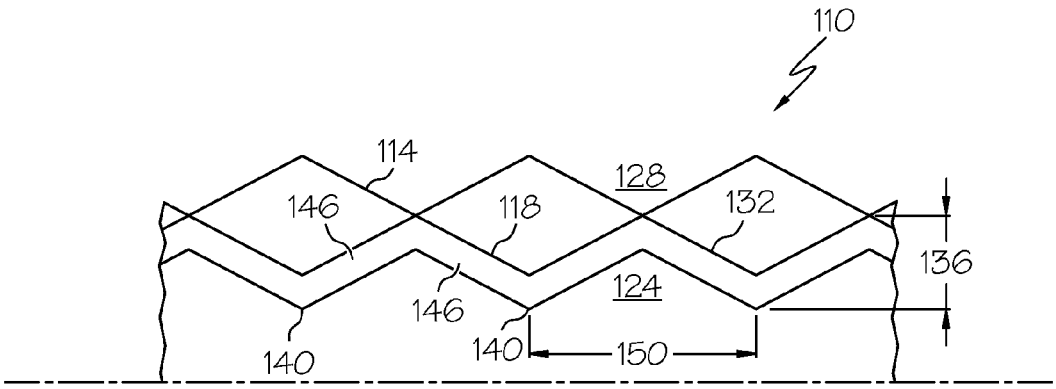
FIG. 5 depicts a partial cross sectional view of an alternate embodiment of an actuator disclosed herein in a nonactuated configuration.
Figure 6:
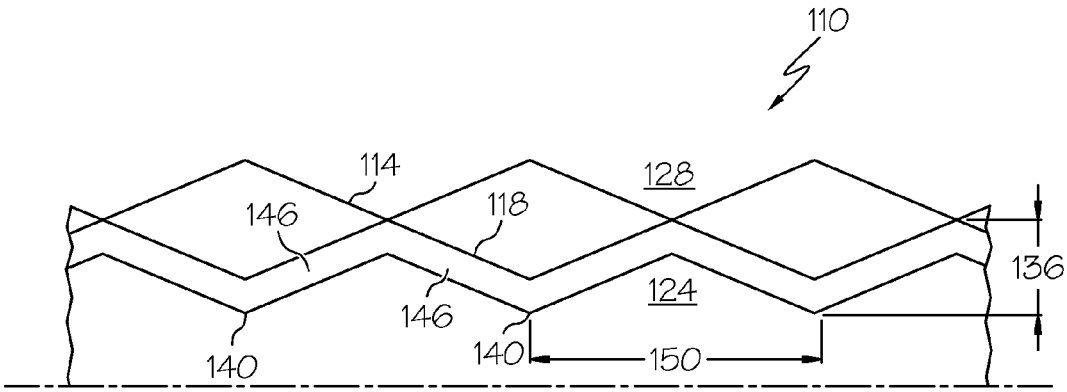
FIG. 6 depicts a partial cross sectional view of the actuator of FIG. 5 shown in an actuated configuration.

Referring to FIGS. 5 and 6, an alternate embodiment of an actuator disclosed herein is illustrated at 110. Unlike the tubular 14 of the actuator 10, a tubular 114 of the actuator 110 has continuous walls. As such a wall 118 of the tubular 114 provides fluidic isolation between an inside 124 and an outside 128 of the tubular 118. A wall 132 of the tubular 114 has a serpentine shape extending in a longitudinal orientation with amplitude 136 in a radial direction. When the actuator 110 is radially expanded inner points 140 of the tubular 114 are moved radially outwardly thereby putting portions 146 of the tubular 114 into compression which causes longitudinally adjacent inner points 140, separated by dimension 150, to move longitudinally away from one another resulting in longitudinal expansion of the actuator 110 as the dimension 150 increases in response to the radial expansion thereof.

Figure 7:
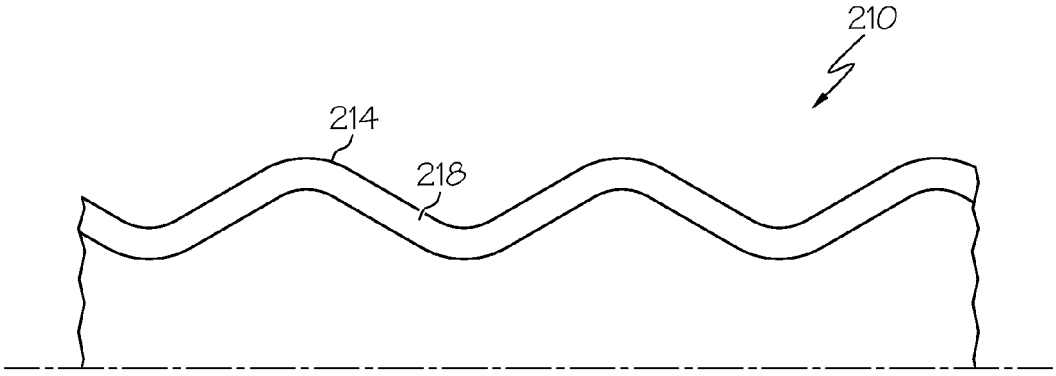
FIG. 7 depicts a partial cross sectional view of another alternate embodiment of an actuator disclose herein.

Referring to FIG. 7, in an alternate embodiment of an actuator 210 disclosed herein, a tubular 214 has a serpentine shape with curved walls 218 as opposed to the straight walls 118 of the actuator 110. Otherwise the actuator 210 is similar to the actuator 110 and functions substantially in the same manner.

Figure 8:
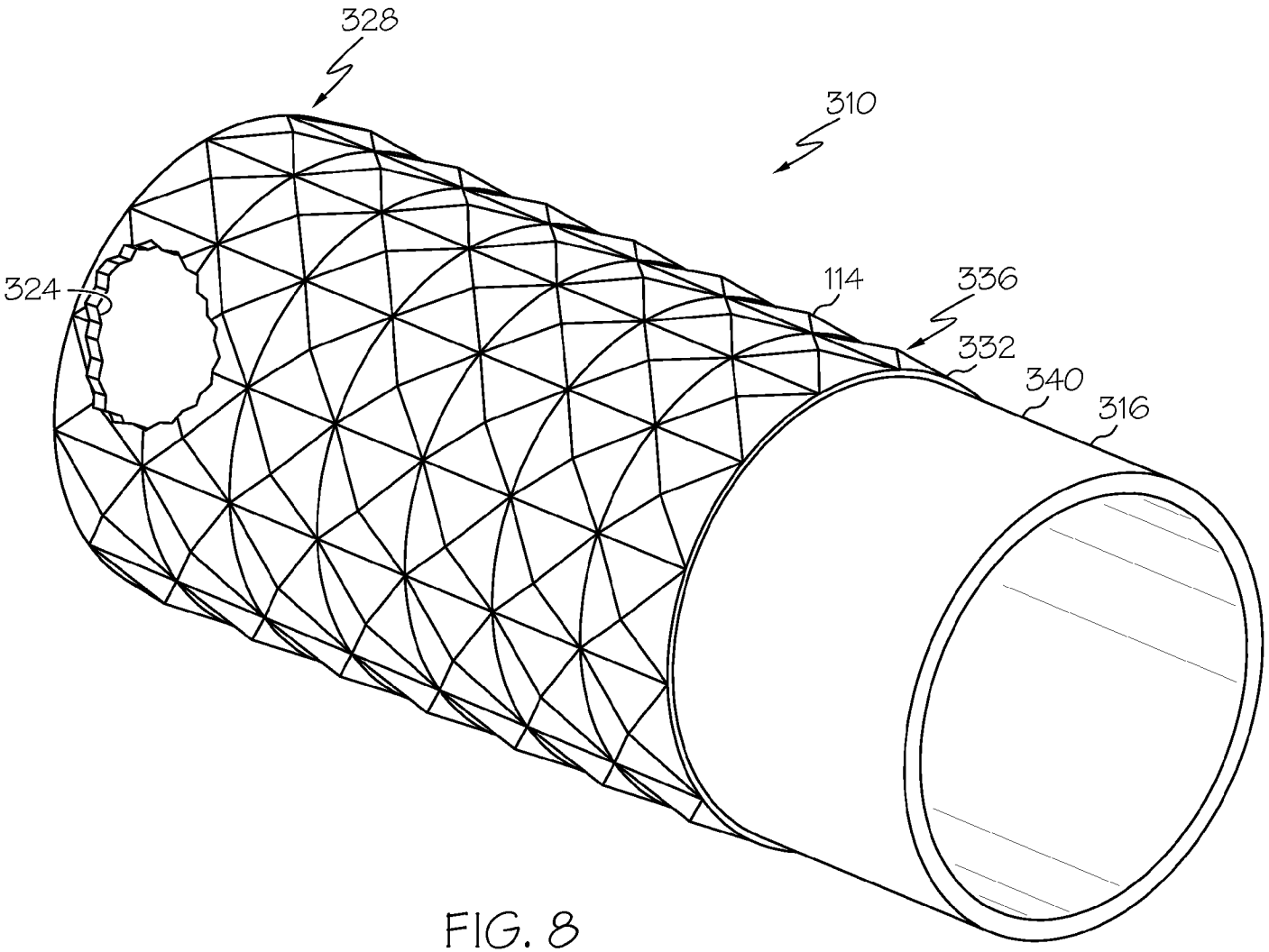
FIG. 8 depicts a perspective view of a tubular actuator disclosed herein.

Referring to FIG. 8, a tubular actuator 310 disclosed herein is illustrated in a perspective view. The tubular actuator 310 includes a sleeve 316 with the tubular 114, positioned radially outwardly of the sleeve 316. A first portion 324 of the tubular 114 is fixedly attached to the sleeve 316 near a first end 328 thereof while a second portion 332 of the tubular 114 near a second end 336 thereof is slidably engaged about the sleeve 316. Both the tubular 114 and the sleeve 316 are radially expandable by operations such as swaging or pressurizing a fluid contained therewithin, for example. The sleeve 316 having a simply cylindrical shape has a positive Poisson's ratio and as such longitudinally contracts upon being radially expanded. In contrast, the tubular 114 has a negative Poisson's ratio, as discussed above and longitudinally expands upon being radially expanded. Assuming the first portion 324 of the tubular 114 and the sleeve 316 attached thereto are stationary, then the tubular actuator 310 will cause an actuatable movement of a portion 340 of the sleeve 316 relative to the second portion 332 of the tubular 114 upon radial expansion of both the sleeve 316 and the tubular 114. This relative motion is generated by movement of the portion 340 of the sleeve 316 toward the first portion 324 while the second portion 332 moves away from the first portion 324. A tool (not shown), by being connected to both the second portion 332 and the portion 340 of the sleeve 316, can be actuated through radial expansion of the tubular actuator 310. It should be noted that although this embodiment discloses the sleeve 316 having a positive Poisson's ratio, other embodiments are contemplated that have non-positive Poisson's ratios. In fact, as long as the Poisson's ratios of the sleeve 316 and the tubular 114 are not the same the tubular actuator 310 will provide relative movement between the portion 340 and the second portion 332 enabling actuation thereby.

Embodiments of the actuators 10, 110, 210 and the tubular actuator 310 disclosed herein can be used in various industries. In the downhole completion industry, for example, the actuators 10, 110, 210, 310 could be used to actuate the following tools; a packer, a centralizer, a backup, an anchor, a valve and a crusher (none shown).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed:

1. An actuator, comprising a tubular configured to longitudinally expand in response to radial expansion of at least a portion of the tubular a wall of the tubular having at least one sinuous member having longitudinal amplitude and a plurality of bars being in operational communication with the at least one sinuous member and alternately directed ends of two of the plurality of bars are connected to one of the at least one sinuous member such that the alternately directed ends overlap longitudinally.

2. The actuator of claim 1, wherein a wall of the tubular is discontinuous.

3. The actuator of claim 1, wherein the two of the plurality of bars are perimetrically adjacent.

4. The actuator of claim 1, wherein an amount of the overlap decreases in response to a decrease in amplitude of the at least one sinuous member.

5. The actuator of claim 1, wherein the plurality of bars are configured to transmit compressive loads.

6. The actuator of claim 5, wherein the compressive loads are directed substantially longitudinally.

7. The actuator of claim 1, wherein the at least one sinuous member includes a plurality of substantially straight portions.

8. The actuator of claim 7, wherein angles between the plurality of substantially straight portions and the plurality of bars increase in response to the radial expansion of the actuator.

9. The actuator of claim 1, wherein the actuator is configured so that the longitudinal amplitude of the at least one sinuous member decreases in response to radial expansion thereof.

10. The actuator of claim 1, wherein the tubular is metal.

11. The actuator of claim 1, wherein a wall of the tubular is continuous.

12. The actuator of claim 1, wherein the tubular fluidically seals an inside from an outside thereof.

13. The actuator of claim 1, wherein a wall of the tubular has a longitudinally oriented serpentine shape.

14. The actuator of claim 13, wherein the longitudinally oriented serpentine shape has a radially defined amplitude.

15. An actuator, comprising a tubular configured to longitudinally expand in response to radial expansion of at least a portion of the tubular, having a sleeve in operable communication with the actuator such that a first end of the actuator is fixed to a first portion of the sleeve and a second end of the actuator moves longitudinally in relation to a second portion of the sleeve in response to radial expansion of the actuator.

16. A tubular actuator, comprising:

a sleeve; and a tubular in operable communication with the sleeve configured to longitudinally expand in response to radial expansion thereof, a first portion of the tubular being longitudinally fixed to the sleeve so that a second portion of the tubular moves in relation to the sleeve in response to the longitudinal expansion of the tubular.

17. The tubular actuator of claim 16, wherein the sleeve has a nonnegative Poisson's ratio.

18. The tubular actuator of claim 16, wherein tubular and the sleeve are nested together.

* * * * *